United States Patent [19]

Garner et al.

[11] 4,067,406

[45] Jan. 10, 1978

[54] SOFT FORMATION DRILL BIT

[75] Inventors: Lloyd L. Garner, San Clemente; Charles Richard Harris, Whittier, both of Calif.

[73] Assignee: Smith International, Inc., Newport Beach, Calif.

[21] Appl. No.: 709,797

[22] Filed: July 29, 1976

[51] Int. Cl.[2] ..... E21B 9/10

[52] U.S. Cl. ..... 175/341; 175/374

[58] Field of Search ..... 175/57, 310, 331, 374, 175/375, 376, 378, 410, 341

[56] References Cited

U.S. PATENT DOCUMENTS

| | | | |
|---|---|---|---|
| 1,847,824 | 3/1932 | Failing | 175/378 |
| 1,897,588 | 2/1933 | Reed | 175/378 |
| 2,244,617 | 6/1941 | Hannum | 175/410 |
| 2,333,746 | 11/1943 | Scott et al. | 175/410 |
| 3,696,876 | 10/1972 | Ott | 175/374 |
| 3,952,815 | 4/1976 | Dysart | 175/374 |

*Primary Examiner*—James A. Leppink

[57] ABSTRACT

A rock bit with rotary cone cutter means having hardened insert teeth utilizing fewer than the normal number of teeth or of cutters used for a given gage hole wherein the cone cutter body is of greater diameter and for approximately the same axial length, of a greater wall thickness and to accommodate a greater insert tooth depth or grip length and permit a proportional increase in extension of the insert from the cutter body to provide greater penetration with fewer insert teeth in contact at a given time, and also providing for increased journal bearing area to increase the life of the extended insert cutters.

10 Claims, 4 Drawing Figures

SOFT FORMATION DRILL BIT

The invention relates to drill bits and more specifically to rock bits for drilling oil wells. It is of particular value in drilling shales, salt, gypsum and the like.

For a number of years drill bits have been manufactured with rotary cone cutters of the milled tooth type. As the term applies, the teeth are milled or machined from the material of the body of the rotary cone. In more recent years it has been the practice to mount hardened inserts of tungsten carbide in place of the milled teeth on the older types of cutters. They are press fitted into sockets drilled in the body of the cone cutter and wear a great deal longer than the milled teeth above mentioned.

When drilling through hard rock formation the hardened insert teeth are subjected to extreme stresses and it is not uncommon for the inserts sometimes to be tilted and completely unseated from the sockets in which they were mounted. If they could be anchored deeply enough in the wall of the rotary cone cutter body the tendency to upset out of their sockets would be reduced but the wall thickness of the cone cutter is limited. The cone has a relatively large generally cylindrical bore from its base end inward to accommodate the journal leg of the rotary bit body and in order to accommodate the cutters within a given gage diameter, the size of the cutters and their wall thickness is necessarily limited.

In hard rock formation it has been no great problem to adequately anchor the inserts in the body of the cone since extension of the inserts from the face of the cone can be quite limited because the hard rock formation will flake off readily under the weight of some thousands of pounds on the drill bit and consequently against the formation on the hole bottom.

It has been found that in drilling in softer formations such as the shales drilling becomes more difficult because the inserts do not flake off the formation as in hard rock drilling. The hardened inserts which are of not too great extension, tend merely to press into the softer formation without removing chips therefrom as in the case of the harder rock. Thus, while the drill bits last longer because of the hardened inserts in the cutters, the bits do not make the desired amount of hole per hour because of ineffective cutting of the softer formation.

One patentee, Ott, in U.S. Pat. No. 3,696,876, Oct. 10, 1972 determined that if he increased the extension of the inserts he could secure better cutting action in soft formations. Among other things he teaches the extension of the inserts from the cutter body distances of one-quarter inch to nine-sixteenths of an inch. The quarter-inch minimum is purportedly greater than previous extensions of insert and the nine-sixteenths of an inch maximum extension is apparently as great as Ott could achieve because satisfactory anchoring of the inserts in the cone body was necessarily limited by limitations in wall thickness of the cone body due to the restrictions imposed by the nature of the bit construction.

Ott in the above identified patent teaches his range of extension of hardened inserts in a rotary drill bit having three cone cutters. Two cone milled tooth cutters have been used heretofore. Three cone milled tooth and insert cutters are in widespread use.

A conventional three cone milled tooth cutter, when new, will cut soft formations faster than a conventional three cone hardened insert cutter. However, even in the softer formations the milled teeth will wear rapidly and the speed of drilling will slow drastically. This fact of course is the reason why hardened insert cutters were put to use.

It was determined that greater and more sustained drilling speed could be attained in soft formations if hardened inserts could be given greater extension from the cone body while at the same time providing sufficient anchorage to maintain them in place. One example of a more firm anchoring of hardened inserts is disclosed in U.S. Pat. No. 3,599,737 to Fischer, Aug. 17, 1971. There the insert is shown with flatted side portions at and just below the exterior surface of the cone body with adjacent portions of said cone body staked to displace metal of the body inwardly against the flatted portions of the insert. However, in Fischer as well as in Ott above, dependable anchoring of the insert in a three cone bit (shown in both patents), is clearly limited by the thickness of the wall of the body of the cone. This is a limitation which takes into account not only the overall wall thickness but maximum insert socket depth commensurate with maintenance of adequate cone body strength.

It has been further discovered that better penetration of soft formation in the hole bottom can be effected by reducing the number of insert teeth in operative contact with the hole bottom at any given time, and if the insert teeth are lengthened, the fewer number of teeth and the extension thereof permit greater and considerably more effective penetration, resulting in much faster drilling rates over far longer periods of time than heretofore achieved.

Another feature of the present invention is also directed to another approach. It does not involve merely an extension outwardly of the hardened insert. It does not involve only the provision of a more firm anchorage in a given depth or grip length. It is directed toward the provision of a cutter of greater diameter and an increased wall thickness in the cone body so that the socket depth or grip length of the insert and the amount of outward extension of the insert can be increased beyond the limits achieved by Ott with greatly improved results over Ott's expressly designated three cone bit.

The present invention is not directed merely to the provision of a two cone cutter with extended inserts. It is directed to a drill bit whose cutter means presents fewer teeth to the hole bottom and which has a greater wall thickness with inserts of greater grip length and greater outward extension in a drill bit of a given gage. The mere fact that two cutters were previously known did not suggest a solution to the problem. It was discovered that the answer lay in the provision of greater wall thickness for the deeper anchoring of hardened inserts to provide for greater extension outward beyond the body of the cone. And this had to be embodied in a bit of a given gage.

It has been determined that a drill bit embodying the features of the present invention produces startling savings in drilling costs. These savings are reflected in both faster drilling rates and reduced trip time. Trip time savings is achieved by reducing the total number of trips for the well.

A milled tooth cutter provides longer teeth and better soft formation penetration than a conventional hardened insert cutter with short insert extension. It will cut faster than the conventional hardened insert cutter in such formations but a milled tooth cutter without a seal has been found to have a life of approximately 15 hours.

A milled tooth cutter with a seal will last approximately 25 to 35 hours. A cutter according to the present invention has been found to last 100 hours in the same or comparable formation. If a bit is cutting at a rate of 100 feet per hour, for example, it readily can be seen that many less drill bits according to the invention will be required to drill soft formation wells to depth of 15 or 19 or 20 thousand feet as compared to a drill bit with milled tooth cutters. Since the trip time for pulling a drill string and bit and again lowering it into the well involves about 1 hour's time for each 1,000 feet of drill string, and in view of the fact that some present drilling rigs have an operating cost of about $1,000 per hour, the saving is quite considerable.

While a drill bit with conventional hardened inserts, extending but a short distance from the cutters, have long life, the extended insert cutters of the present invention have been found to penetrate approximately 50% faster in a soft formation such as Bedford limestone.

It is a general object of the invention to achieve the results and advantages set forth above.

Other objects and advantages will be more fully apparent from the following description in connection with the accompanying drawings.

Figure 1:
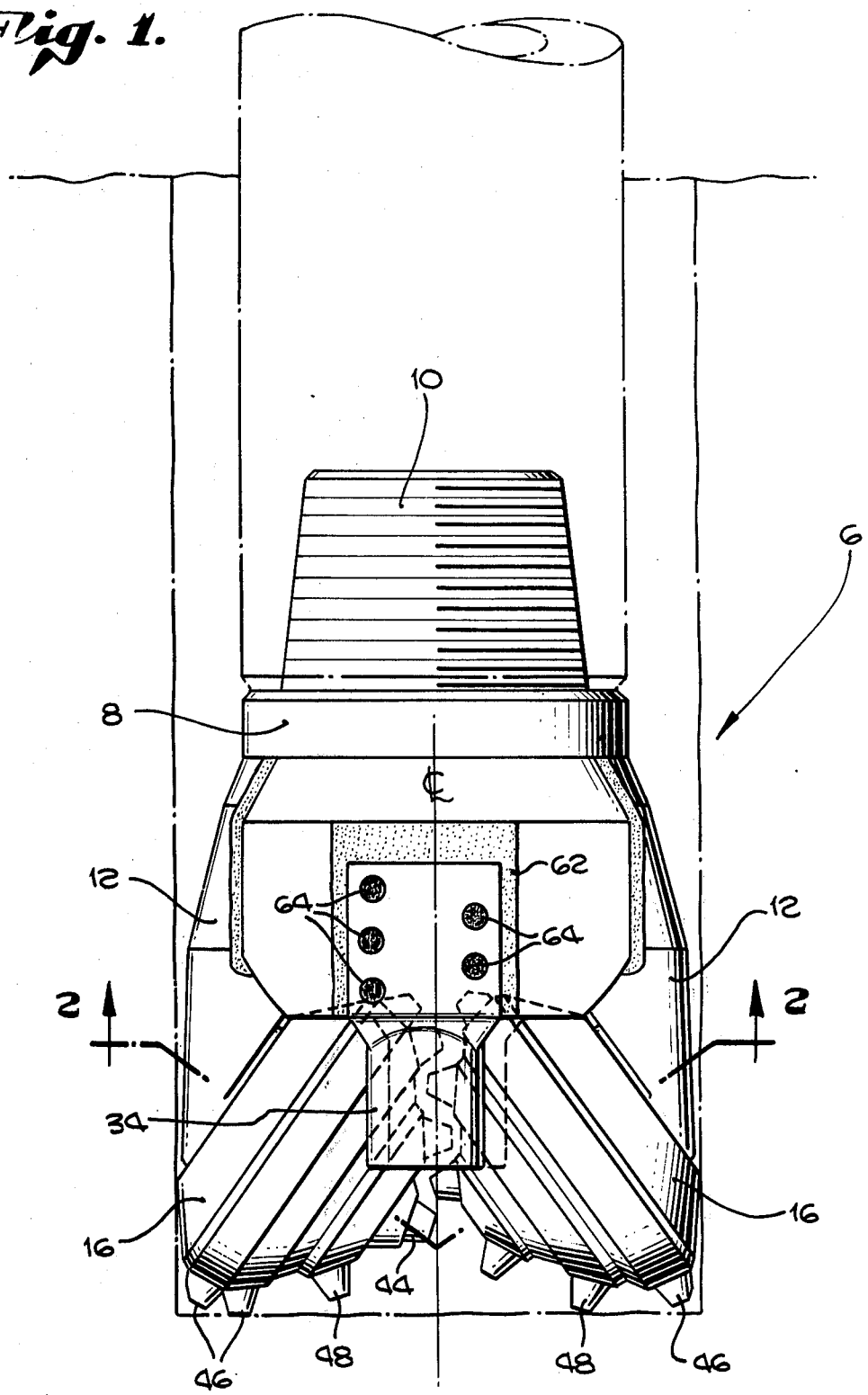
FIG. 1 is a side elevational view of an embodiment of the invention.

There is illustrated a drill bit 6 having a body 8 with an upward extension 10 having conventional means (not shown) for connecting the bit to the lower end of a drill string. The bit body 8 has oppositely disposed downwardly extending journal legs 12, each with a downwardly and inwardly extending journal 14 adapted to rotatably support a cone cutter 16. The journal 14 has a cylindrical bearing surface 18 and customarily has a reduced end portion 20 which rotates against a thrust button 22 of hard bearing material. Journal 14 is also provided with a circumferential groove 24 which, with a corresponding groove 26 in the interior of the cone cutter 16, provides a ball race for ballbearings 28. Preferably an O-ring seal 30 is provided between the rotary cutters 16 and the inner end of the journal 14. Customarily a suitable lubricant is supplied to the bearing elements within the rotary cone 16 in a manner well understood in the art and therefore not illustrated.

Extending downwardly from opposite sides of the bit body 8 from the underside or dome 32 of said bit body are nozzles 34 having flow passages 36 which terminate near the lower portions of the cutters 16. Drilling mud pumped under pressure down through the drill string and through suitable passage means in the bit body 8 is directed downwardly through the nozzles 34 and against the bottom of the hole being drilled to pick up and remove cuttings of the formation and return them to the surface in the drilled hole around the string of drill pipe.

Each cutter 16 is generally cone shaped and provided with a cavity 38 inwardly from its larger or base end to accommodate the journal 14. The cavity has different diameters and the external surface of the cutter 16 has an irregular profile so that the thickness of the cutter wall 40 varies quite considerably. While the entire cutter 16 must naturally have sufficient strength to withstand the weights and shocks to which it is subjected in its normal operation, there is one wall thickness which is quite critical. That is the thickness between bearing ball 28 and the point 42 on the outer surface of the cone 16 which is nearest said ball 28. The cone wall thickness radially outward from a considerable portion of the journal 14 is quite considerable and much more so than at the point 42. This is a natural consequence of the generally conical shape of the cutter 16. Because of the conical shape of the cutter 16, the relatively thinner wall thickness at 42 is important and must not be weakened because the bearing balls 28 are subjected to a considerable portion of the stresses placed upon the rotary cutters due to the thousands of pounds of weights imposed upon the bit and the jarring shocks to which the cutters are subjected in their normal operation.

Each of the rotary cone cutters 16 is provided with hardened inserts known in the art as nose inserts 44, one row of gage inserts 46 and one or more rows of intermediate inserts 48. There may be one or more of the nose inserts 44. The gage inserts 46 are spaced in rows about the base portion of the cone cutters 16 and they cut the outer diameter or gage of the hole. The intermediate inserts 48 lie in rows about the cone between the nose insert or inserts 44 and the gage row inserts 46.

The inserts 44, 46, and 48 are of an extremely hard alloy such as tungsten carbide. The rotary cone 16 is drilled from the outer surface inward to provide sockets into which the hardened inserts are press fitted. It is generally considered accepted practice to provide the inserts with an insert depth or grip length which is approximately equal to or greater than the extension of the insert from the face of the cone. If the grip length is too short relative to the extension, the insert will distort its socket and come out of the cone cutter. Even with present accepted grip length ratios one or more inserts may become dislodged from the support cutter body but in general the inserts will remain in place and will remove hard rock formations effectively through the life of the bit.

It has been known for some time that rotary cutter bits with hardened inserts suitable for hard rock formations were not effective in cutting softer formations. Conventional relatively short insert extensions of 5/16 of an inch to 9/32 of an inch, because of some soft formations encountered, tend to press the formation inwardly rather than to pierce or fracture it as in the case of harder formations. Desirable tooth extension has been achieved in milled tooth cutters but the effective life of such cutters is materially shorter than that of a hardened insert.

Ott in his above identified patent teaches that insert extension in soft formations is desirable. He did this by extending the inserts a greater distance, by providing a particular location of the intermediate row of inserts of one cutter and different relative locations of the intermediate rows of the other two cutters in a conventional three cone cutter, and finally by placing the axes of rotation of the cones on lines offset from the rotational axis of the drill bit as a whole. This latter feature is stated to provide a scuffing or scavenging action of the hardened inserts against the bottom of the hole. Ott explicitly limits his disclosure and his claims to a three cone bit. The extension of the inserts of Ott is limited to 9/16 of an inch. He states in column 5, lines 6 through 9 of his patent, "The distance that the inserts protrude is governed to a great extent by the thickness or diameter of the insert and the size of the bit in which the inserts are used."

The present invention permits insert extension to be increased far beyond that of Ott or in the neighborhood of approximately 1 inch, nearly twice the extension by Ott within the limits of his construction. While it is true that insert diameter is a factor, it has been found that grip length or depth of insert mounting in the wall of the cone is of greater importance. The problem was how to secure increased cone cutter wall thickness in a drill bit of a given diameter in order to provide for greater insert extension and the required increased grip length in the cone without weakening the cone structure.

It was found that greater wall thickness in the rotary cone cutter could be achieved by increasing the diameter of the rotary cone. This could be accomplished only by reducing the number of cone cutters because an increased wall thickness would take up more space in a given drill bit diameter. It was also found that by increasing the diameter of the cone, a journal of larger diameter could be accommodated in the cone, thereby increasing bearing surface and considerably lengthening the life of the drill bit.

Futhermore, where only two of the larger diameter cone cutters with their longer inserts were used for drilling soft formations there were fewer insert teeth in contact with the formation at any given time, and with the extension of the inserts beyond Ott's 9/16 of an inch and up to approximately 1 inch, faster drilling speed resulting from greater insert penetration was secured because there were fewer teeth penetrating the formation at one time. Holes were drilled in Bedford limestone with a 7⅞ inch diameter drill bit with three cone cutters having inserts of approximately 5/16 extension, a length in common use, and with an embodiment of the present invention having an insert extension approximately 18% greater than that on a three cone cutter and having a wall thickness from the bearing wall 28 to the point 42 which is approximately 16% greater than that of the wall thickness at a comparable point on a three cone cutter with normal wall thickness. This is the previously cited test which resulted in a 50% faster penetration rate. In creating such an extension it was also found advisable, as did Ott, to increase the diameter of the inserts. Diameter of the more extended insert tooth was increased 6%.

The quite considerable 60% increase in wall thickness from bearing ball to surface was achieved mainly by the increased diameter of the rotary cone but it was also benefited by the fact that the relief of the cone to accommodate the intermesh between the rows of insert teeth on adjacent cutter cones did not have to be as deep. Where three cutters are used in a bit it is necessary to relieve some of the metal of the cone between the rows of inserts of the cone in order to permit the intermesh of the rows of inserts. This relief, even with a greater insert extension, is less with the cutters of the present invention.

By increasing the amount of metal section in the rotary cone for a given bit diameter it was also found that the journal cavity in the cone could be made deeper and of greater diameter. The cylindrical bore 38 could be made approximately 15% greater axially of the cone and the journal bearing surface area, based upon a 6% increase in diameter, could be increased approximately 38%. This is a highly important fact in drill bits because if a proper seal is maintained by the O-ring seal 30, a drill bit with hardened insert teeth has a life limited primarily by the life of the bearing means.

Figure 4:
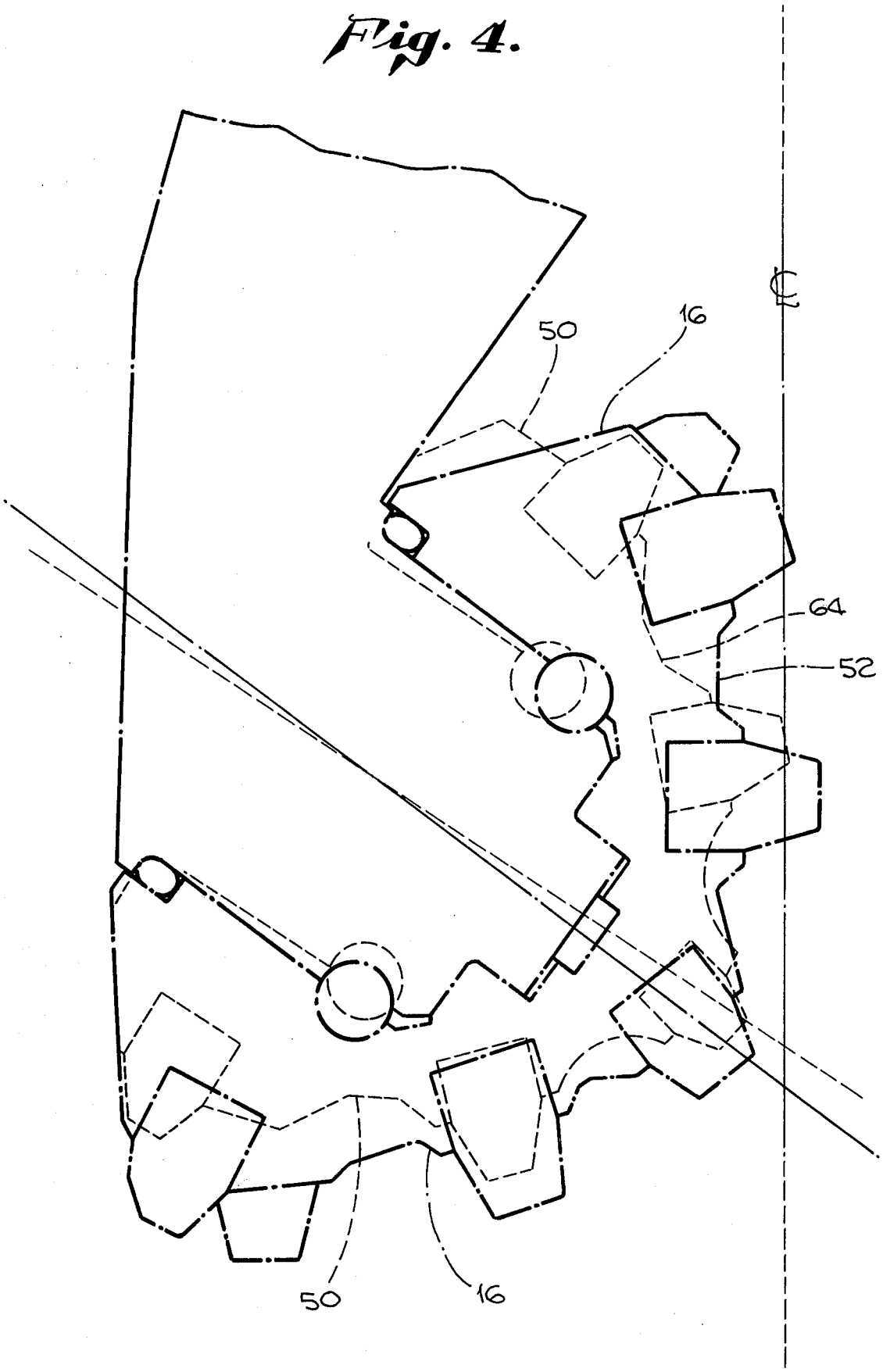
FIG. 4 is a diagrammatic view of a cutter embodying the invention with a conventional cutter overlay.

Reference is made to FIG. 4 wherein the cone 16, embodying the features of the invention is shown overlaid by a cutter cone 50, cutter 16 being one of a two cone bit cutter and cutter 50 being one of a three cone bit cutter for a bit of common gage or hole diameter. The overlaid cutter representations are taken from bits of 7⅞ inches in diameter and are on the same scale. It will be seen that the bit of the invention No. 16 is of considerably greater diameter and wall thickness and that the inserts have noticeably greater extension than those of the conventional cutter 50. The extension of the inserts of the invention beyond their intersection with the center line or axis of rotation of the bit body is clearly exemplified in FIG. 4. In this view it can be seen that the valleys 52 on the cutter 16 are not nearly as deep as the valleys 54 on the conventional cutter 50.

The axes of the cutters 16 and 50 in the overlay of FIG. 4 are not coincident. This is due to the fact that the journal of the improved cutters 16 is tilted downwardly at a slightly greater angle than that of the cutter 50. This is the result of the difference between the angle between the axes of two adjacent cones in a three cone bit and in a two cone bit.

While it is preferred that two rotary cone cutters with thickened walls and extended inserts be used in place of three cutters in a given bit diameter, it should be understood that under certain conditions it might be desirable to utilize only one rotary cone cutter. There would of course be a different arrangement of the inserts and preferably would include probably more than one intermediate row of inserts or a staggered intermediate placement thereof.

Figure 2:
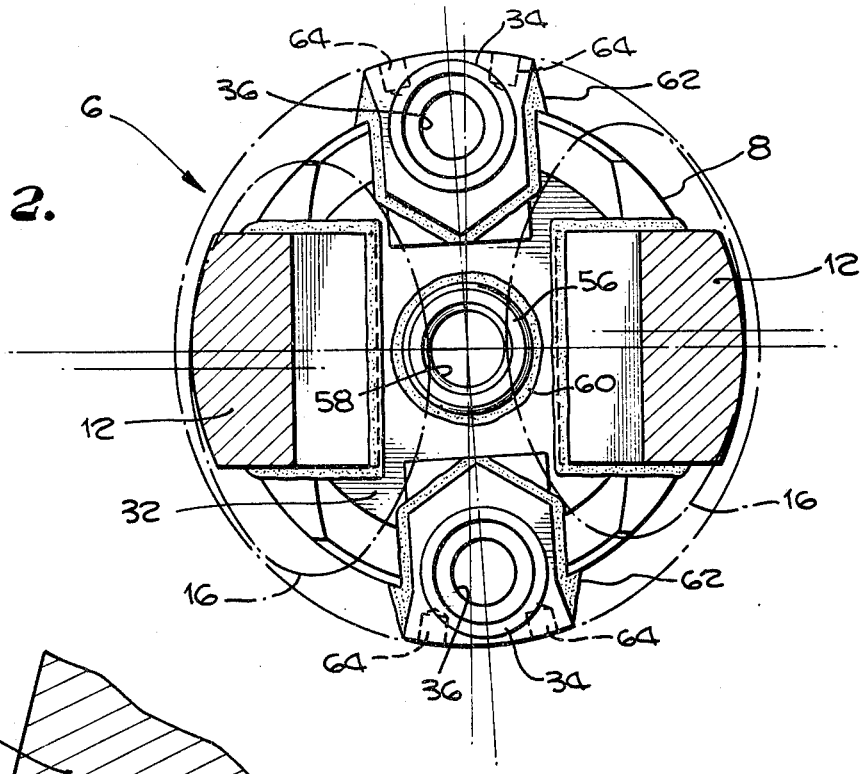
FIG. 2 is a section taken approximately on the line 2—2 of FIG. 1.
Figure 3:
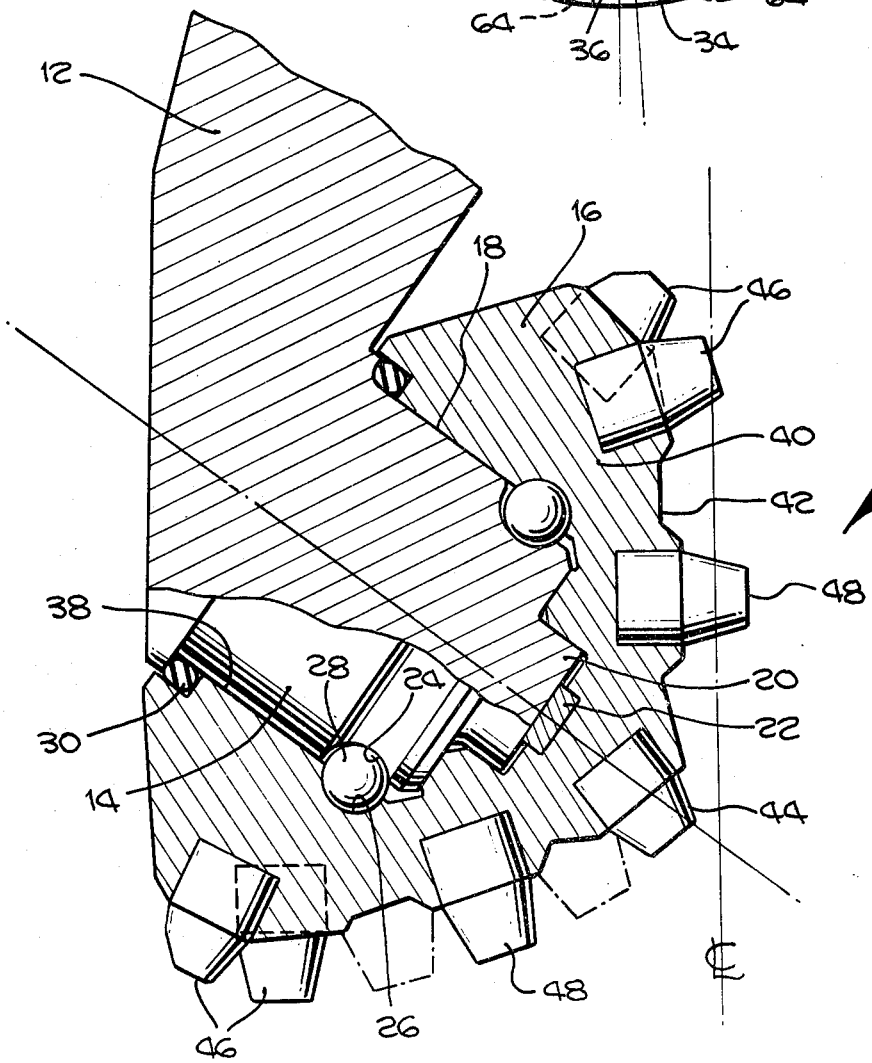
FIG. 3 is an enlarged axial sectional view through one of the journal legs and a cone cutter.

Because the rotary cone cutters are spaced a considerable distance from each other as compared to the spacing in a bit with three cutters, it is possible to provide the additional advantage of much more efficient nozzle means. In FIGS. 1, 2 and 3 a nozzle 56 is shown extending down through the center of the dome 32 of the bit body 6 in a conventional manner. The additional space provided by the reduction in the number of the rotary cone cutters 16 permits the nozzles 34 at either side of the bit body to extend downwardly between the cutters so that they terminate only a short distance above the hole bottom so that drilling mud under pressure will be directed downward against the formation at the bottom of the hole in close proximity thereto to provide effective agitation and pick up of those portions of the formation being drilled which have been broken off by the hardened inserts extending from the rotary cutters.

The passages 36 in the lateral extended nozzles 34 are supplied with drilling mud through a vertical central bore 58 in the bit body 8. The nozzle extensions 34 are secured to the bit body by welds 60 and 62.

From the foregoing it will be seen that there is provided a drill bit for faster and more efficient cutting of softer formations. It involves the outward extension of hardened insert teeth in rotary cutters greater than heretofore found possible in order to overcome what might be termed the spongy resistance of the soft formations to penetration by the hardened inserts of a lesser extension used in harder formation. The greater extension accomplished hereby is enhanced by having fewer teeth in contact with the hole bottom formation at any given time so that there are fewer of the more extended teeth so engaged and better and more efficient penetration results. It is preferred that a two cone or even a one cone bit for a given gage with extended teeth permitted by greater rotary cone diameter and wall thickness be utilized.

It should be understood that various changes can be made in the form, details, arrangement or proportions of the various parts and the steps of the method without departing from the spirit of the invention.

What is claimed is:

1. A drill bit for drilling holes in soft formations such as limestones, shales or the like, comprising:

a bit body of given diameter adapted for rotation about an axis within a cylindrical space and having an under side comprising a dome, no more than a pair of journal leg means extending downwardly from said body and having journal means extending downwardly and inwardly within said cylindrical space from the lower end portions of the journal legs beneath said dome, rotary cone cutter body means on said journal means, the approximate slant height line of the surface of the rotary cone cutter body means intermediate the base and apex of the cone where the cutter means is nearest said axis of the bit, is approximately parallel to said axis, hardened insert means imbedded in and extending from said rotary cone cutter body means, said insert means being disposed about said rotary cone cutter body means, and said insert means being of such length that, when the rotary cone cutter body means is in drilling position, at least a portion of said insert means extends outwardly from said surface of the rotary cone cutter body means to intersect the axis of rotation of the bit body while the material of the cone cutter body per se is spaced laterally from said axis.

2. The structure in claim 1, and in said drilling position, the base of the cone cutter means is approximately as low as its apex.

3. The structure in claim 1, and the nearest proximity of said rotary cone cutter means to said bit axis along its slant height being approximately vertical, and said inserts being extended from said rotary cone cutter means a minimum of one-quarter of an inch.

4. The structure in claim 3, and said extension being up to approximately 1 inch.

5. The structure in claim 1, and said rotary cone cutter means having rows of inserts thereabout, and at least some cutters of a row intersecting said axis.

6. The structure in claim 1, and said rotary cone cutter means comprising a pair of rotary cone cutters having rows of said inserts thereabout, and some of the hardened inserts of at least one row of inserts of at least one rotary cone cutter intersecting the axis of said bit body.

7. The structure in claim 1, and said rotary cone cutter means comprising a pair of rotary cone cutters, and some hardened inserts of at least one cone intersecting the axis of said bit body.

8. The structure in claim 1, and there being essentially two rotary cone cutters, each having rows of hardened inserts thereabout and extending therefrom, and the rows of inserts in one cutter intermeshing with the rows of inserts in the other cutter.

9. The structure in claim 1, and there being essentially a pair of rotary cone cutters, each having hardened inserts therein and extending therefrom, and the inserts in one cutter intermeshing with those in the other cutter.

10. The structure in claim 9, and the inserts in both rotary cone cutters intersecting said axis of said bit body.

* * * * *